US010584437B2

(12) United States Patent
Lee et al.

(10) Patent No.: US 10,584,437 B2
(45) Date of Patent: Mar. 10, 2020

(54) DRUM TYPE WASHING MACHINE

(71) Applicant: LG ELECTRONICS INC., Seoul (KR)

(72) Inventors: Gunho Lee, Seoul (KR); Hyunchul Choi, Seoul (KR); Jeongkeun Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 246 days.

(21) Appl. No.: 15/696,648

(22) Filed: Sep. 6, 2017

(65) Prior Publication Data

US 2018/0105968 A1 Apr. 19, 2018

(30) Foreign Application Priority Data

Oct. 13, 2016 (KR) ..... 10-2016-0132794

(51) Int. Cl.

| | |
|---|---|
| ***D06F 37/22*** | (2006.01) |
| ***D06F 39/00*** | (2020.01) |
| ***D06F 37/06*** | (2006.01) |
| ***D06F 37/26*** | (2006.01) |
| ***D06F 37/30*** | (2020.01) |
| *D06F 39/12* | (2006.01) |

(52) U.S. Cl.

CPC ..... *D06F 37/22* (2013.01); *D06F 37/06* (2013.01); *D06F 37/266* (2013.01); *D06F 37/304* (2013.01); *D06F 39/001* (2013.01); *D06F 37/267* (2013.01); *D06F 39/12* (2013.01)

(58) Field of Classification Search

CPC ..... D06F 37/22; D06F 37/06; D06F 37/266; D06F 37/304; D06F 37/267; D06F 39/001; D06F 39/12

See application file for complete search history.

(56) References Cited

U.S. PATENT DOCUMENTS

2004/0037640 A1* 2/2004 Kim ..... D06F 39/001 403/408.1

FOREIGN PATENT DOCUMENTS

| | | |
|---|---|---|
| KR | 10-0230481 | 11/1999 |
| WO | WO 02/44458 | 6/2002 |

OTHER PUBLICATIONS

European Search Report dated Feb. 19, 2018 issued in Application No. 17189737.4.

* cited by examiner

*Primary Examiner* — Michael E Barr
*Assistant Examiner* — Tinsae B Ayalew
(74) *Attorney, Agent, or Firm* — Ked & Associates, LLP

(57) ABSTRACT

A drum type washing machine comprising a tub mounted in a cabinet and supported by a damper and a spring in the cabinet; a coupling boss protruding from a rear surface of the tub; a transit bolt configured to be coupled to the coupling boss through an insert hole formed at a rear surface of the cabinet to fix the tub to the cabinet when transporting the drum type washing machine; and an elastically deformable hole cap configured to be attached to the insert hole from an inside of the cabinet, the hole cap including a plurality of slits through which the transit bolt passes.

20 Claims, 8 Drawing Sheets

DRUM TYPE WASHING MACHINE

CROSS-REFERENCE TO RELATED APPLICATIONS

This application claims priority under 35 U.S.C. § 119 to Korean Application No. 10-2016-0132794, filed on Oct. 13, 2016 in Korea, the entire contents of which is hereby incorporated by reference herein in its entirety.

BACKGROUND

1. Field

The present disclosure relates to a drum type washing machine.

2. Background

A washing machine is an electric appliance configured to wash off dirt or contaminants from clothes or laundry, using chemical resolution and mechanical impact. There have recently been increasing demands for drum type washing machines which are capable of reducing wrinkles and entanglement in laundry as well as reducing an overall height of the washing machine, compared with a pulsator type washing machine including a rotary tub mounted vertically and a pulsator.

Such the drum type washing machine includes a cabinet, a tub mounted in the cabinet and supported by a damper and a spring, a cylindrical drum mounted in the tub and holding laundry, and a drive unit connected with the drum to rotate the drum. The drum type washing machine is provided with a rotational force from the drive unit via a shaft. While the drum is rotated, laundry is lifted and dropped by gravity to perform a washing cycle.

When transporting the drum type washing machine, although the tub is supported by the spring and the damper, it might move right and left severely so that a force may be applied to the drive unit or damage the tub or cabinet. To prevent the shaking, a coupling device to temporarily fix the tub to the cabinet is provided when transporting the drum type washing machine.

Korean Registered Patent Gazette No. 10-0230481 discloses "Coupling Structure of Transit Bolt in Drum Washer" as one example, whose disclosure is hereby incorporated by reference in its entirety. In the related art washer, a plurality of bolt-insert holes that couple the tub to the cabinet are formed in the cabinet and a transit bolt is inserted in the bolt-insert holes to fixed the cabinet to the tub.

The transit bolt is fastened to fix the tub in the cabinet only when transporting the drum type washing machine so as to prevent movement of the tub. Once the drum type washing machine is installed, the transit bolt is removed from the bolt-insert hole.

If a user's finger happens to be inserted into an area of the plurality of the inert holes formed in a rear surface of the cabinet, it may cause injury. Further, if water enters into the insert holes, there might be a negative impact on the electronic components of the drive unit arranged in a rear portion of the tub, for example, a short circuit or corrosion.

A hole cap may be provided to block the fixing insert-holes at the outside of the cabinet after the drum type washing machine is installed. When the drum type washing machine is shipped, such a hole cap for blocking the insert hole is packed and stored in an auxiliary bag and is likely to be lost. Also, an installation engineer might forget to block the hole with the hole cap after removing the transit bolt after installing the drum type washing machine.

A fixing hook is provided at a front end of an extension extended from the hole cap to prevent the loss of the hole cap and a fixing hole is provided in the cabinet to have the fixing hook insertedly coupled thereto, to avoid the loss of the hole cap. However, the fixing hook is likely to reduce the chance of hole cap loss but the fixing hook is arranged on an outer surface of the cabinet and also might be separated from the fixing hole. As such, the hole cap of the related art may still be lost.

Moreover, it is difficult and inconvenient to separate the fixing bolt and block the insert hole with the hole cap after the drum washing machine is installed. There still exists the concern that the insert hole is left open after the fixing bolt is released. The above references are incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DESCRIPTION OF SPECIFIC EMBODIMENTS

Figure 1:
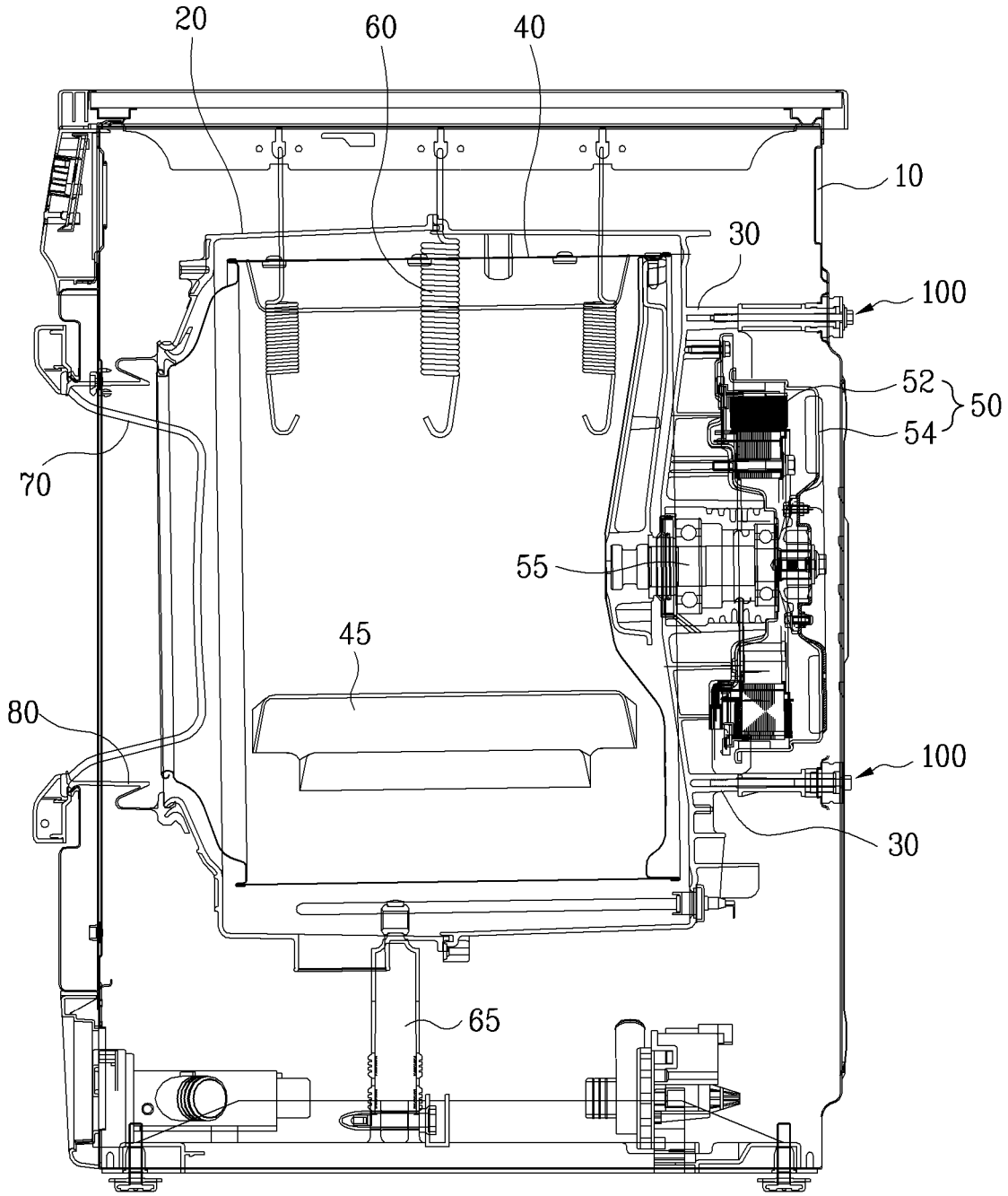
FIG. 1 is a sectional diagram of a drum type washing machine in accordance with an embodiment of the present disclosure.

As shown in FIG. 1, a drum type washing machine in accordance with an embodiment may include a rectangular-shaped cabinet 10; a tub 20 supported by a damper 65 and a spring 60 within the cabinet; a cylindrical drum 40 rotatably provided in the tub; and a drive unit (or drive) 50 axially connected with the drum 40. The drive unit 50 may include a rotor 54 and a stator 52 which are mounted to a rear surface of the tub 20.

A wash shaft 55 rotatable together with the drum may be directly connected to the rotor 54 to directly transmit the drive force of the rotor to the drum 40, with no pulley or belt. A door 70 may be provided at a predetermined position of a front surface of the cabinet 10, corresponding to an opening of the tub 20. A gasket 80 may seal a gap between the tub 20 and the door 70.

The drum type washing machine having the configuration mentioned above may have the rotational force of the rotor 54 transmitted to the drum 40 via the wash shaft 55. While the drum 40 is rotated, laundry may be lifted by one or more lifters 45 projected from an inner circumferential surface of the drum and dropped by gravity, to perform a wash cycle.

The tub 20 may be supported by the spring 60 and the damper 65, so that the tub 20 may shake vertically and horizontally when such the drum type washing machine is transported. Accordingly, a force may be applied to the drive unit 50 provided adjacent to the tub 20 or damage the cabinet 10 disadvantageously.

To prevent this, a coupling device to couple the tub 20 to the case may be provided. The coupling device may include a coupling boss 30 provided at a rear surface of the tub 20 and a transit bolt 100 coupled to the coupling boss 30, penetrating an insert hole formed at a rear surface of the cabinet 10.

Figure 3:
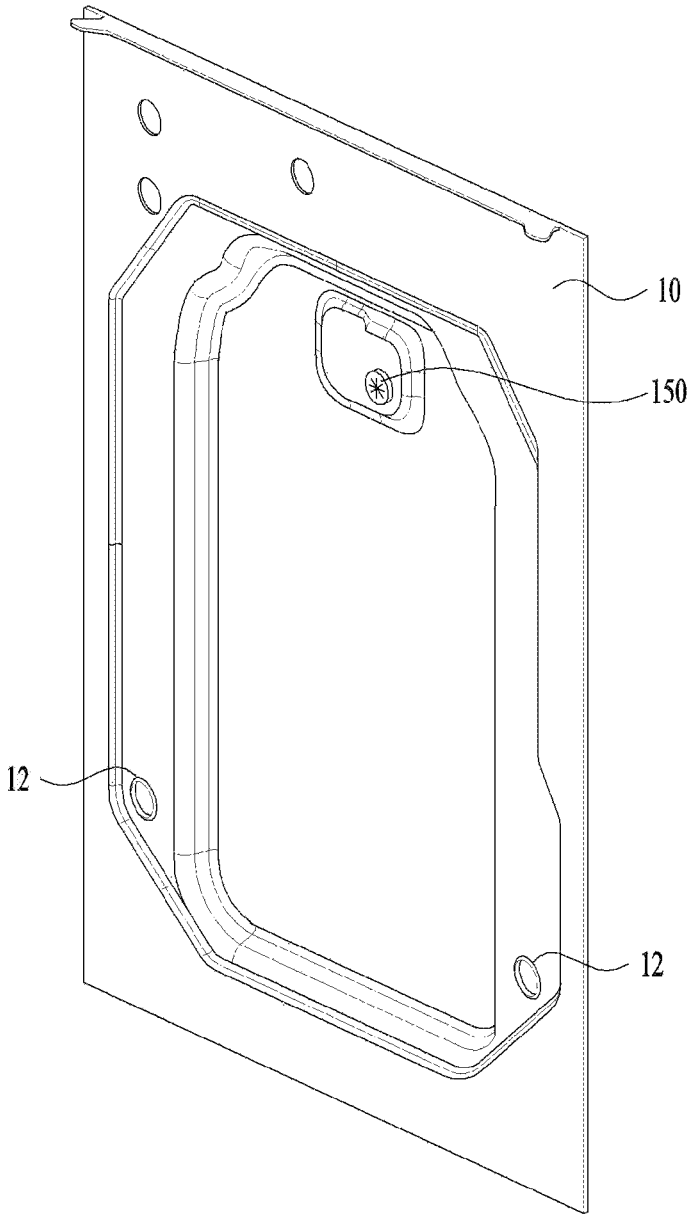
FIG. 3 is a perspective diagram illustrating that a hole cap is insertedly coupled to an insert hole formed in a rear surface plate of a cabinet.
Figure 4:
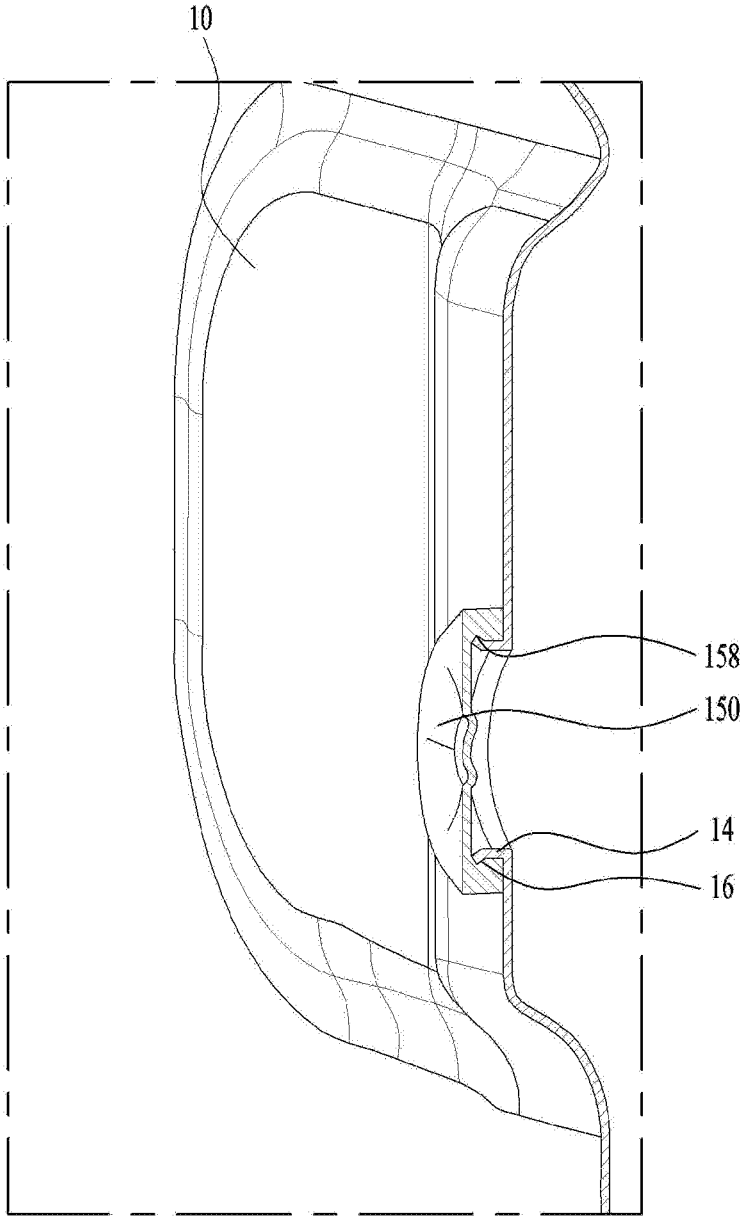
FIG. 4 is a sectional diagram of the hole cap shown in FIG. 3, cut away along a plane crossing the hole cap.

An insert hole 12 may be formed in a rear surface plate of the cabinet 10 and the transit bolt 100 may penetrate the insert hole 12. As shown in FIG. 3, one insert hole 12 may be formed in an upper region and two insert holes 12 may be formed in both lower side regions.

Three of four insert holes 12 may be formed in regions of the tub rear surface, corresponding to the coupling bosses 30 provided in the rear surface plate of the cabinet. A hole cap 150 may be secured in the cabinet 10 corresponding to each insert hole 12, and a plurality of slits (154, see FIG. 5) may be formed in the hole cap 150 for the transit bolt 100 to pass through.

As shown in FIG. 3, the hole cap 150 may be coupled to the upper insert hole 12, but hole caps 150 may be absent the lower side insert holes 12. As can be appreciated, the hole caps may be provided to the lower side insert holes 12.

The transit bolt 100 may include a body 102 having a preset outer diameter; a head 104 formed at a first end of the body and configured to be hooked to the cabinet; and a male screw portion (or screw) 103 formed at a second end of the body 102 to a predetermined length. A diameter of the male screw portion 103 (threaded end) may be larger than a diameter of the body 102.

The coupling boss 30 may project a preset length from the rear surface of the tub 20 toward the rear surface of the cabinet 10. The coupling boss may be integrally formed with the tub 20. A hole may be formed in a center of the coupling boss 30 and a female screw or threaded portion (or screw hole) 33 may be formed on an inner circumferential surface of the hole, corresponding to the male screw portion 103 of the transit bolt 100.

A bolt holder 110 may be provided between the coupling boss 30 and the rear surface plate of the cabinet 10 to maintain a preset gap there between. A hole may be formed in a center of the bolt holder 110 for the body 102 of the transit bolt 100 to pass through. An inner diameter of the hole may be equal to or a larger than an outer diameter of the male screw portion 103 provided on the transit bolt 100.

The bolt holder 110 may be penetrated by the transit bolt 100 and then the transit bolt 100 may be coupled to the coupling boss 30 through the insert hole 12 and the hole cap 150. Once the bolt holder 110 is assembled, a front end surface may contact a projected surface of the coupling boss 30 and a rear end may contact the rear surface plate of the cabinet 10, so as to maintain a gap between the coupling boss 30 and the cabinet 10.

A bushing member (or bushing) 120 may be provided with the bolt holder 110 and configured to absorb impact by being inserted in the insert hole 12, while surrounding an outer circumferential surface of the bolt holder 110 and forming a seal between the insert hole 12 and the bolt holder 110. The bushing member 120 may be secured over a predetermined region to be arranged over the inside and outside of the cabinet via the insert hole 12. The bushing member 120 may include a first stepped surface 121 and a second stepped surface 122.

A through hole may be formed in a center of the bushing member 120 and the bolt holder 110 may be inserted in the through hole. When the bushing member 120 is provided, a rear end of the bolt holder 110 may contact the bushing member 120, not the rear surface plate of the cabinet directly.

To accommodate such contact, a support protrusion 114 may project from the outer circumferential surface of the bolt holder 110 in a radial direction, and a rear surface of the support protrusion 114 may contact a front surface of the bushing member 120. The bushing member 120 may be fixed by fastening the transit bolt 100, when the transit bolt 100 is inserted in the insert hole 12.

A washer 140 may be further provided between the bushing member 120 and the transit bolt 100. An outer diameter of the washer 140 may be approximately equal to an outer diameter of the bushing member 120. A central hole of the washer 140 may have a predetermined diameter which is larger than the body 102 and smaller than the head 104 of the transit bolt 100.

A front half of the busing member 120 may have an outer diameter which is equal to an inner diameter of the insert hole 12 to be inserted in the insert hole and the rear half of the bushing member 120 may have an outer diameter which is larger than the insert hole 12. More specifically, the front half of the bushing member 120 may be arranged in the cabinet 10 and the rear half may be arranged outside the cabinet 10 when the bushing member 120 is assembled. The bushing member 120 may be made of an elastic material such as rubber and pressed by the washer 140, the cabinet 10, and the bolt holder 110 to form a seal between the insert hole 12 and the bolt holder 110.

A front portion of the support protrusion 114 projected from the bolt holder 110 may have an outer diameter which is close to an inner diameter of the insert hole 12. A rear portion of the support protrusion 114 may contact the bushing member 120 and may have an outer diameter which is smaller than the inner diameter of the insert hole 120. In other words, the bolt holder 110 may be stepped for the rear portion of the support protrusion 114 to have a smaller outer diameter.

A hooking protrusion (or lip) 116 may be further provided at a rear end of the bolt holder 110 and projected in a radial direction. A rear end of the inner circumferential surface of the bushing member 120 may be stepped so that the bushing member 120 may be hooked to the hooking protrusion 116. Accordingly, the bushing member 120 located between the support protrusion 114 and the hooking protrusion 116 may be secured to the outer circumferential surface of the bolt holder 110.

The insert hole 12 may have a circular extended portion (or lip) 14 extending from a rim of the insert hole forward and the hole cap 150 may be coupled to the insert hole, surrounding the extended portion 14. The cabinet 10 may be formed as a metal plate and the insert hole 12 may be formed by punching, for example. When the punching is performed, the extended portion 14 may be formed.

Figure 5:
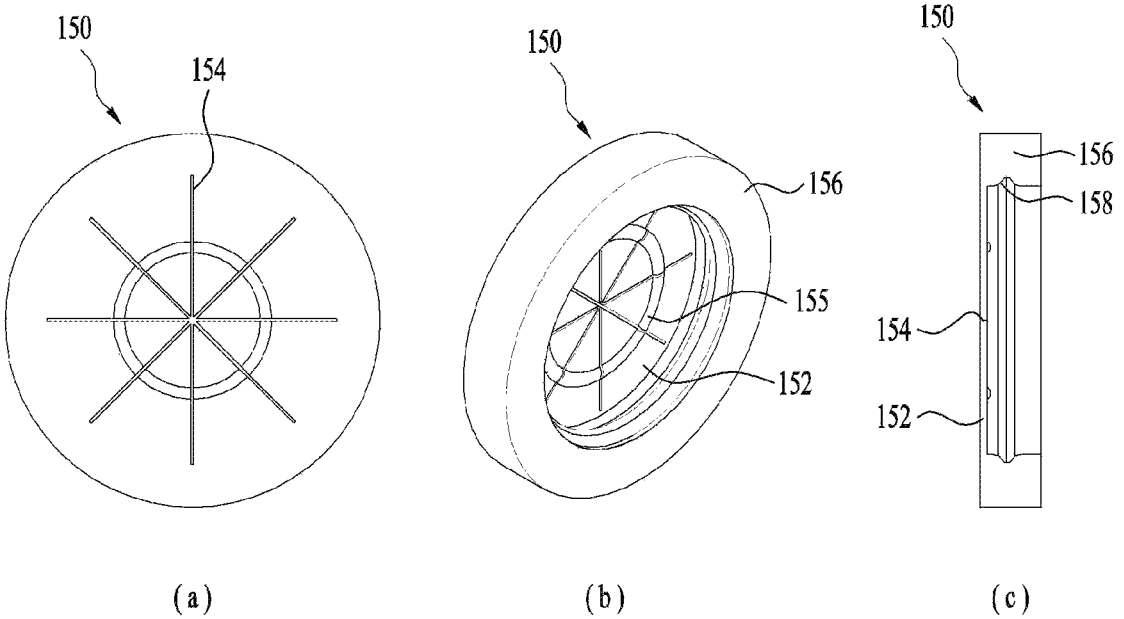
FIG. 5 includes a rear view (a), a perspective view (b) and a sectional view (c) of the hole cap.

As shown in FIG. 5, the hole cap 150 may include an elastic deformation portion 152 having a plurality of slits 154 passing through and an edge portion 156 integrally formed with a rim of the elastic deformation portion 152 while being thicker than the elastic deformation portion 152. The plurality of slits 154 may be formed in a center of the elastic deformation portion 152 and the transit bolt 100 and the bolt holder 110 may pass through the slits. A fan-shaped region divided by the slits 154 may be pushed and forwardly bent by the transit bolt and the bolt holder 110.

Once the inserted transit bolt 100 is released, the elastic deformation portion 152 may return to its original position to block the insert hole 12. To accommodate this, the elastic deformation portion 152 may be made of an elastic material such as rubber.

The edge portion 156 surrounding the circular extended portion 14 may be insertedly fitted adjacent to the circular extended portion 14 so as to not be easily separated. The elastic deformation portion 152 and the edge portion 156 may be integrally formed with each other, made of one material such as rubber, for example.

The circular extended portion 14 extending from the insert hole 12 of the cabinet 10 may include a rib 16 projected from an outer circumferential surface thereof in a radial direction. The hole cap 150 may include a groove 158 formed at an inner circumferential surface of the edge portion 156 to insert the rib therein. The insert hole 12 and the circular extended portion 14 may be formed by punching, for example. A front end of the circular extended portion 14 may be widened outward in a radial direction by the punching to form the rib 16.

Figure 2:
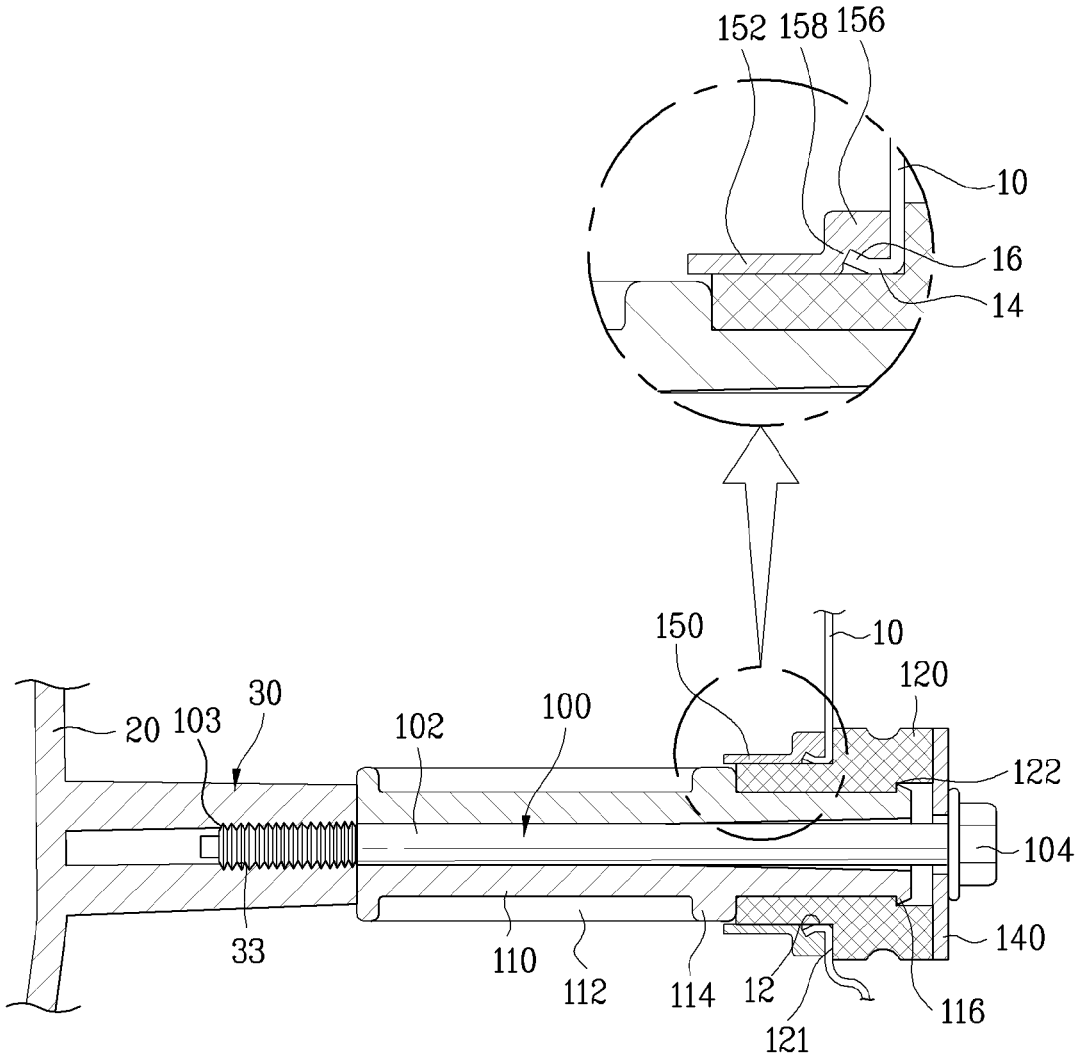
FIG. 2 is a sectional diagram illustrating a transit bolt coupling structure in accordance with an embodiment.

As shown in FIGS. 2 and 5, the groove 158 may be formed at the inner circumferential surface of the hole cap 150 to have the rib 16 forcibly inserted therein, so that the hole cap 150 insertedly fitted to the circular extended portion 14 of the insert hole 12 may not be released easily. The hole cap 150 may further include a circular rib 155 projected from one surface of the elastic deformation unit 152, in which the transit bolt 100 is pushed to be inserted, in a ring shape.

When the bolt holder 110 having the bushing member 120 coupled thereto is insertedly pushed with the transit bolt 100 through the elastic deformation portion 152 of the hole cap 150, the front end of the transit bolt 100 may push the center of the elastic deformation portion 152 and the bolt holder 110 may push the elastic deformation portion 152 to bend it at a 90 degree angle. When the user pushes the transit bolt 100 consistently in this state, the bent elastic deformation portion 152 may apply a force to the outer circumferential surface of the bolt holder 110 and the friction force between the elastic deformation portion 152 and the bolt holder 110 may make it difficult to push the transit bolt 100. Accordingly, only the circular rib 155 projected from one end of the elastic deformation portion 152 may contact the outer circumferential surface of the bolt holder 110 so as to reduce friction.

Figure 6:
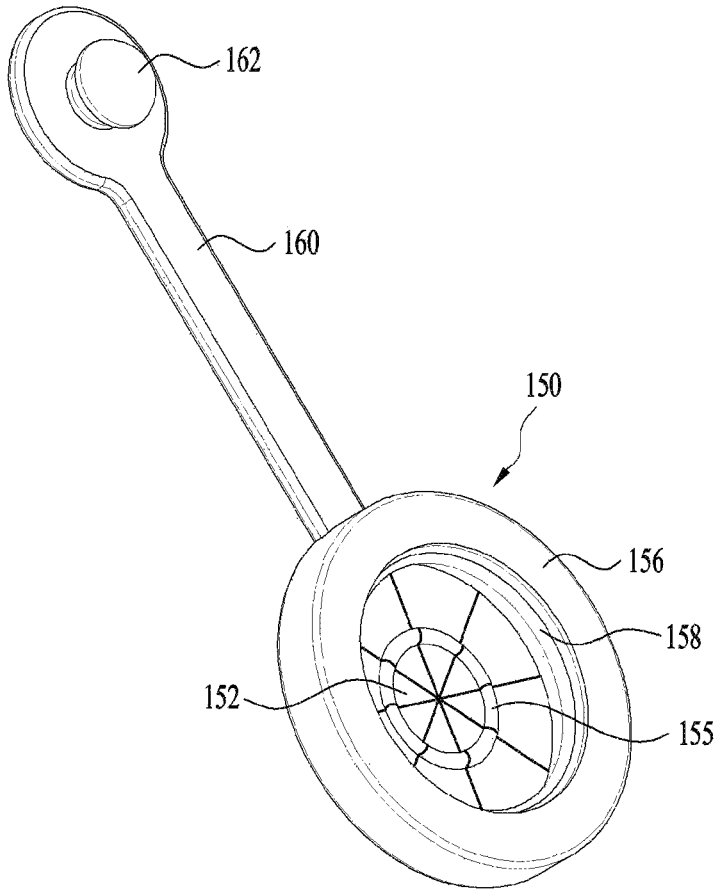
FIG. 6 is a perspective diagram illustrating a hole cap in accordance with another embodiment.

The bolt holder 110 may include a plurality of ribs 112 formed on an outer circumferential surface thereof in an axial direction to reduce the friction more by reducing the contact area with the elastic deformation portion 152 when pushing in the elastic deformation portion 152. The plurality of ribs 112 are shown in FIG. 2 and most specifically shown in FIG. 6 illustrating another embodiment presenting the extended portion 160.

Grooves may be formed between two neighboring ribs formed on the outer circumferential surface of the front half of the support protrusion 114, so that the ribs 112 may be formed between the grooves, and have a same height as the support protrusion 114. The plurality of ribs 112 may line-contact with the elastic deformation portion 152, not surface-contact, so that the transit bolt 100 and the bolt holder 110 may be easily inserted by reducing the friction when the elastic deformation portion 152 slides along the outer circumferential surface of the bolt holder 110.

When the circular rib 155 is formed on the elastic deformation portion 152 and the plurality of the ribs 112 is formed on the outer circumferential surface of the bolt holder 110, the circular rib 155 may contact the plurality of the ribs 112 alternatively to reduce the contact area and then the friction. As shown in FIG. 2, the transit bolt 100 may be pushed through the elastic deformation portion 152 and then coupled to the coupling boss 30. Thus, the elastic deformation portion 152 may contact the outer circumferential surface of the bushing member 120.

Next, another embodiment of the hole cap will be described, referring to FIGS. 6 through 8. The hole cap 150 shown in FIG. 6 may further include an extended portion 160 (or extension) extending from the edge portion 156 and a projected portion (or nub) 162 formed at one end of the extended portion 160.

The extended portion 160 may extend from the outer circumferential surface of the edge portion 156 outward with respect to a radial direction. The projected portion 162 may project from one end of the extended portion 160 in an axial direction.

Figure 7:
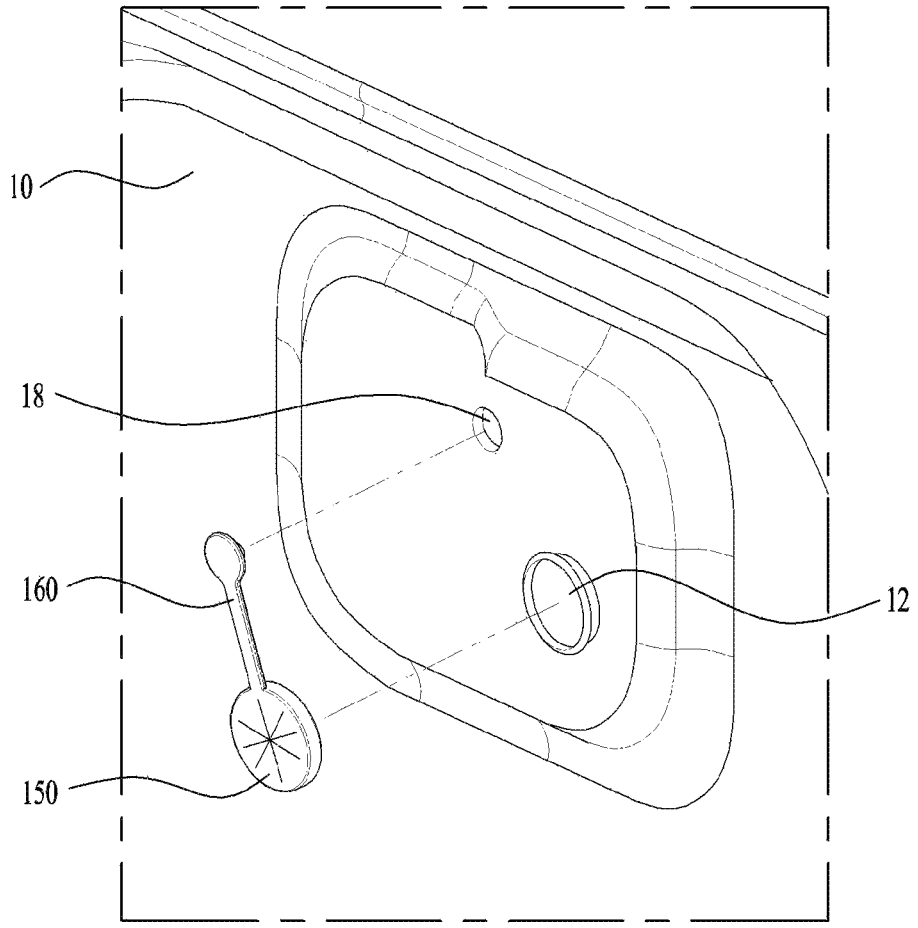
FIG. 7 is a perspective diagram illustrating that the hole cap of FIG. 6 is coupled to a rear surface plate of a cabinet.

As shown in FIG. 7, a securing hole 18 may be formed in the rear surface plate of the cabinet 10, adjacent to the insert hole 12, to have the projected portion 162 insertedly secured thereto. The securing hole 18 may be arranged at a left region over the insert hole 12. The securing hole 18 may be formed adjacent to the insert holes at a position higher than the insert holes 12, corresponding to the length of the extended portion 160.

In order to hang the hole cap 150 downward by gravity when projected portion 162 of the hole cap 150 is inserted in the securing hole 18, the securing hole 18 may be arranged over the insert holes 12. The projected portion 162 may project from a first side of the end of the extended portion 160 to have a smaller outer diameter than the insert hole 12 and may be integrally formed with the end in a hemisphere shape.

The hemispheric end of the projected portion 162 may have a larger diameter than the insert hole 12, so that it may be forcibly inserted into the insert hole 12. In addition, the end of the extended portion 160 may be formed in a larger circular shape than the insert hole 12 to hide the insert hole 12. This may prevent foreign substances from entering the gap between the projected portion 162 and the insert hole 12 once the projected portion 162 is inserted in the insert hole 12.

This embodiment of the hole cap 150 may not only prevent the edge portion 156 from becoming released from the extended portion 14 of the insert hole 12, but also may prevent the loss of the hole cap 150. The two embodiments of hole cap 150 mentioned above may be made of EPDM (Ethylene Propylene Diene Monomer) rubber.

EPDM rubber may consist of terpolymers with a small amount of non-conjugated diene to provide unsaturation to a side chain of a main chain configured of ethylene and propylene. Such EPDM rubber may be fabricated by a mixture of carbon black, light filler, zinc oxide, antioxidant, processing aid, petroleum-based plasticizer and vulcanizing agent. The EPDM rubber may have an excellent tensile strength, elastic strain, and high-temperature performance according to the proper adjustment of the mixed components.

In the present embodiments, the hole cap 150 may block the insert hole 12 by the restituting after separating the transit bolt 100, even though the elastic deformation portion 152 may be easily bent. Also, the hole cap 150 may not be easily divided or cut even when each portion repeats the elastic deformation. The EPDM rubber may satisfy the specifications required by such the hole cap 150.

Before transporting the drum type washing machine, the hole cap 150 may be fixed to the circular extended portion 14 in the cabinet 10 and the projected portion 162 of the extended portion 160 may also be fixedly inserted in the securing hole 18. Once the transit bolt 100 having the bolt holder 110, the bushing member 120, and the washer 140 inserted therein is pushed in the insert hole 12, the elastic deformation portion 152 of the hole cap 150 shown in FIG. 8 may be bent almost 90 degrees and widened.

In this instance, the friction between the bolt holder 110 and the elastic deformation portion 152 may be reduced by the plurality of the ribs 112 formed in the outer circumferential surface of the holt holder 110 and the circular rib 155 formed in the surface of the elastic deformation portion 152. Accordingly, the user may be able to insertedly push the transit bolt 152 and the bolt holder 100 through the elastic deformation portion 152, even with a small force.

Figure 8:
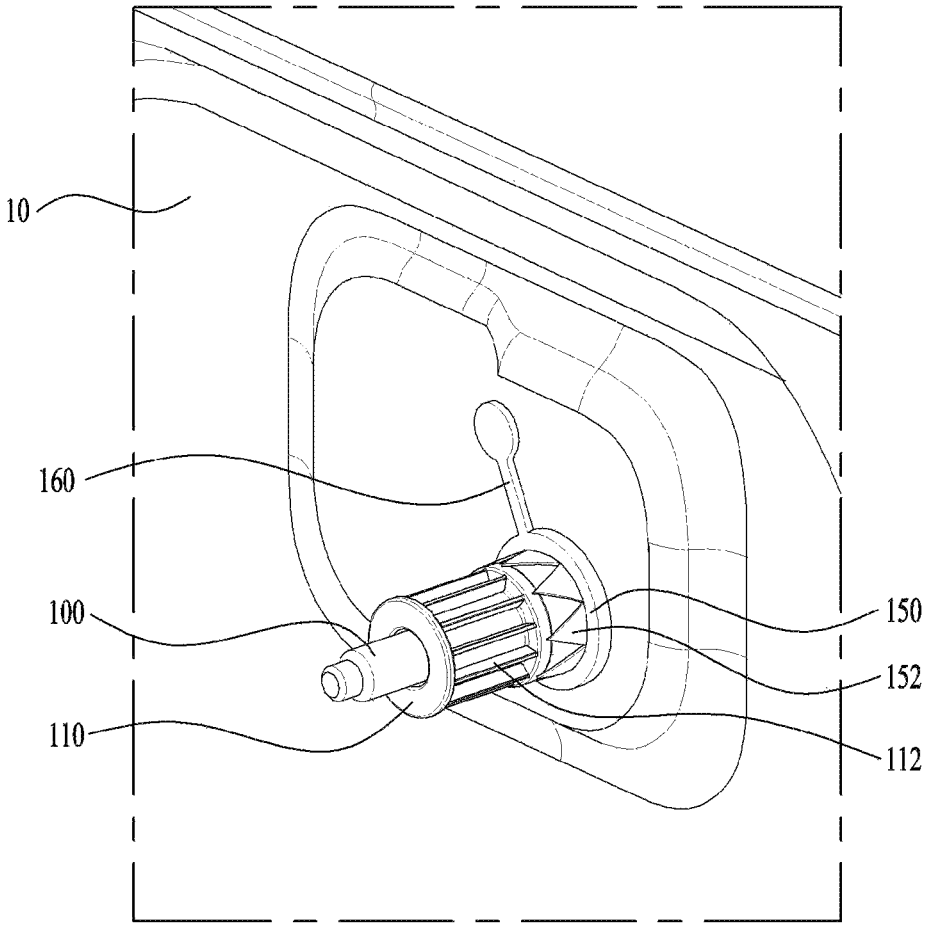
FIG. 8 is a perspective diagram illustrating that a transit bolt is inserted in the hole cap of FIG. 7.

FIG. 8 illustrates a state where the transit bolt 100 is coupled to the coupling boss 30 but the coupling boss 30 is omitted in FIG. 8. In the state shown in FIG. 8, the elastic deformation portion 152 widened in the shape of the fans is supported to the outer circumferential surface of the bushing member 120.

Accordingly, the drum type washing machine of the present disclosure need not separate the fixed hole cap when the transit bolt is coupled to transport the drum type washing machine. Furthermore, when the transit bolt is released and separated even after transporting and installing the drum type washing machine, the elastic deformation portion of the hole cap may restitute and block the insert hole.

A drum type washing machine may comprise a tub mounted in a cabinet and supported by a damper and a spring in the cabinet; a coupling boss at a rear surface of the tub; a transit bolt configured to be coupled to the coupling boss via an insert hole formed at a rear surface of the cabinet so as to fix the tub to the cabinet when transporting the drum type washing machine; and a hole cap configured to be inserted in the insert hole from an inside of the cabinet and elastically deformable, the hole cap including a plurality of slits for the transit bolt to pass through them. The hole cap may be secured in the insert hole of the cabinet and it may be deformed to insert the transit bolt in the plurality of the slits. Accordingly, it may be unnecessary to separate the hole cap when coupling the transit bolt and block the insert hole by coupling the hole cap even when releasing the transit bolt.

The drum type washing machine may further include a bolt holder secured to the transit bolt to cover an outer circumferential surface of the transit bolt to keep a gap between the coupling boss and the cabinet and including a hole through which the transit bolt passes. The drum type washing machine may further include a bushing member configured to be inserted in the insert hole while surrounding an outer circumferential surface of the bolt holder so as to absorb impact and seal between the insert hole and the bolt holder.

The insert hole may include a circular extended portion extending from a rim forward, and the hole cap may be coupled to surround the extended portion. The hole cap may include an elastic deformation portion formed for the plurality of the slits to pass a center thereof; and an edge portion integrally formed with the rim of the elastic deformation portion and thicker than the elastic deformation portion.

The extended portion may include a rib projected from an outer circumferential surface thereof in a radial direction, and the hole cap may include a groove formed in an inner circumferential surface of the edge portion and configured to have the rib inserted therein. The rib of the extended portion may be compressedly fitted in the groove formed in the edge portion of the hole cap. Accordingly, the hole cap may not be easily separated when coupled.

The hole cap may further include a circular rib projected from one surface of the elastic deformation portion, which the transit bolt pushes in, in a circular ring shape. The bolt holder may include a plurality of ribs formed in an outer circumferential surface thereof in a longitudinal direction so as to reduce a contact area with the elastic deformation portion and thus friction when pushing in the elastic deformation portion. The friction between the elastic deformation portion and the bolt holder may be reduced remarkably by the circular rib of the hole cap and the ribs of the bolt holder to facilitate the inserted coupling between the transit bolt and the bolt holder.

The hole cap may further include an extension extending from an outer circumferential surface of the edge portion in a radial direction; and a nub projected from a first end of the extension and configured to be inserted in a securing hole formed in the cabinet. Even if the secured hole cap is not released by the groove of the hole cap and the rib of the extended portion, the nub formed in the extension of the hole cap may be inserted in the through hole of the cabinet and fixed to the cabinet. Accordingly, the hole cap may be further prevented from releasing during the inserted coupling of the bolt holder.

The hole cap may be made of EPDM (Ethylene Propylene Diene Monomer) rubber. The hole cap may be made of the EPDM rubber, so that it may not become released easily after secured to the extended portion of the insert hole and that it can block the insert hole by the elastic deformation portion's completely restituting in releasing the transit bolt, even though the elastic deformation portion is easily deformable.

According to the drum type washing machine of the embodiments of the present disclosure, it may not be necessary to separate a hole cap from an inert hole of a cabinet when a transit bolt is coupled and to block an inert hole even when a transit bolt is released, only to couple the hole cap to the insert hole. Furthermore, the hole cap may always be fixed to the insert hole of the cabinet and not easily separated. Accordingly, there is no concern of hole cap loss.

Still further, the elastic deformation unit of the hole cap may block the insert hole cap by restituting spontaneously. Accordingly, there is no need of additional processes except the fastening and releasing process of the transit bolt.

Still further, the bolt holder may be provided in the outer circumferential surface of the transit bolt and the gap between the tub and the cabinet may be kept. Also, the bushing member may be provided in the outer circumferential surface of the bolt holder and configured to stop the deformation of the cabinet. Accordingly, the gap between the insert hole and the transit bolt may be sealed.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A drum type washing machine comprising:

a tub mounted in a cabinet and supported by a damper and a spring in the cabinet;

a coupling boss protruding from a rear surface of the tub in a first direction;

a bolt configured to be coupled to the coupling boss through an insert hole formed at a rear surface of the cabinet to fix the tub to the cabinet during transport of the drum type washing machine, wherein the bolt is removed after transport; and a deformable cap configured to be attached to the insert hole from an inside of the cabinet, the deformable cap including a plurality of slits to allow insertion of the bolt through the deformable cap prior to transport.

2. The drum type washing machine of claim 1, further including:

a bolt holder configured to surround an outer circumferential surface of the bolt to maintain a gap between the coupling boss and the rear surface of the cabinet and including a through hole through which the bolt passes.

3. The drum type washing machine of claim 2, further including:

a bushing configured to be inserted in the insert hole while surrounding an outer circumferential surface of the bolt holder so as to absorb impact and form a seal between the insert hole and the bolt holder.

4. The drum type washing machine of claim 1, wherein the hole includes a lip extending toward an interior of the cabinet, and the deformable cap is coupled to surround the lip.

5. The drum type washing machine of claim 4, wherein the deformable cap includes:

a first portion including the plurality of the slits arranged at a center of the deformable cap; and a second portion integrally formed at a rim of the first portion to be thicker than the first portion in the first direction.

6. The drum type washing machine of claim 5, wherein the lip includes a rib projecting from an outer circumferential surface of the lip in a radial direction, and the deformable cap includes a groove formed along an inner circumferential surface of the second portion and configured to have the rib inserted therein.

7. The drum type washing machine of claim 5, wherein the deformable cap further includes a circular rib projecting from a first surface of the first portion in a circumferential direction and configured to be pushed by the bolt holder.

8. The drum type washing machine of claim 5, wherein the bolt holder includes, a plurality of ribs formed along an outer circumferential surface thereof in an axial direction to reduce a contact area between the first portion of the deformable cap and the bolt holder.

9. The drum type washing machine of claim 5, wherein the deformable cap further includes:

an extension that extends from an outer circumferential surface of the second portion of the deformable cap in a radial direction; and a nub projected from a distal end of the extension and configured to be inserted into a securing hole formed in the cabinet.

10. The drum type washing machine of claim 1, wherein the deformable cap is made of EPDM (Ethylene Propylene Diene Monomer) rubber.

11. A washing machine, comprising;

a cabinet including at least one hole;

a tub mounted in the cabinet and including a coupling boss protruding in a first direction towards the at least one hole;

an elastic cap attached to the at least one hole and having a plurality of flaps configured to allow passage through the insert hole;

a bolt holder configured to penetrate the elastic cap and contact the coupling boss; and a bolt inserted through the bolt holder and coupled to the coupling boss; wherein when the bolt holder and bolt are removed from the washing machine, the plurality of flaps closes to cover the insert hole.

12. The washing machine of claim 11, further including a plurality of ribs projected radially and extending axially along an outer circumferential surface of the bolt holder.

13. The washing machine of claim 11, further including a bushing that surrounds the bolt holder and includes a first stepped surface facing a second direction opposite the first direction that contacts an outside of the cabinet and the at least one hole.

14. The washing machine of claim 13, wherein the bolt holder further includes a lip protruding circumferentially from a first end, and wherein a first surface of the lip facing the second direction contacts a second stepped surface of the bushing facing the first direction.

15. The washing machine of claim 11, wherein the at least one hole further includes a lip protruding towards an interior of the cabinet.

16. The washing machine of claim 15, wherein the lip further includes a rib bent outward from an edge of the lip.

17. The washing machine of claim 16, wherein the elastic cap further includes a groove configured to allow the elastic cap to be attached to the rib.

18. The washing machine of claim 11, wherein the elastic cap further includes an extension that extends radially and includes a first end attached to the elastic cap and a second end opposite the first end, and wherein the extension includes a hub that protrudes from the second end in the first direction.

19. The washing machine of claim 11, wherein the plurality of flaps includes a circular rib formed on a first surface of each flap facing the first direction such that the bolt holder contacts the circular rib while being inserted through the plurality of flaps.

20. A washing machine comprising:

a drum configured to receive items to be washed;

a tub, the drum being provided in the tub;

a cabinet housing the tub, the cabinet having at least one insert hole at a rear surface of the cabinet;

a coupling boss protruding from a rear surface of the tub in a first direction;

a holder configured to maintain a gap between the coupling boss and the rear surface of the cabinet and including a through hole;

a bushing inserted into the at least one insert hole and surrounding an outer surface of the holder; and an elastic cap attached to the at least one hole and having a plurality of slits.

* * * * *